US007202429B2

(12) United States Patent
Bouvier et al.

(10) Patent No.: US 7,202,429 B2
(45) Date of Patent: Apr. 10, 2007

(54) SWITCH WITH LIGHT SUPPORTED IN OPERATING MEMBER

(75) Inventors: Laurent Bouvier, Monnieres (FR); Laurent Kubat, Dole (FR); Sylvain Rochon, Dole (FR)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 28 days.

(21) Appl. No.: 11/176,708

(22) Filed: Jul. 7, 2005

(65) Prior Publication Data

US 2005/0263380 A1 Dec. 1, 2005

(51) Int. Cl.
*H01H 9/18* (2006.01)

(52) U.S. Cl. ..... 200/310; 200/314

(58) Field of Classification Search ..... 200/406, 200/516, 310, 314
See application file for complete search history.

(56) References Cited

U.S. PATENT DOCUMENTS 4,056,701 A * 11/1977 Weber ..... 200/314
4,096,368 A * 6/1978 Grebner ..... 200/314
4,496,813 A * 1/1985 Fukushima ..... 200/314
4,751,385 A * 6/1988 Van Benthusysen et al. .... 200/314
5,201,408 A * 4/1993 Torma et al. ..... 200/314
5,399,820 A * 3/1995 Silfvast ..... 200/314
5,543,594 A * 8/1996 Romero-Herrera ..... 200/314
5,823,326 A * 10/1998 Saito et al. ..... 200/314
5,898,147 A 4/1999 Domzalski et al.
6,310,308 B1 10/2001 Watson et al.

FOREIGN PATENT DOCUMENTS

WO WO 2004/064093 7/2004

* cited by examiner

*Primary Examiner*—Michael A. Friedhofer
(74) *Attorney, Agent, or Firm*—Peter Van Winkle

(57) ABSTRACT

A switching device includes a vertically moveable operating member (14) with a cavity (66) in which a light (20) lies. The light is supported on tongues (80) of a pair of sheet metal energizing members (70A, 70B). Each energizing member has laterally opposite sides that form a pair of legs (74). The legs extend downward along opposite sides of the switch casing (12), and the legs have lugs (76) at their lower ends for soldering to traces on a circuit board.

5 Claims, 4 Drawing Sheets

SWITCH WITH LIGHT SUPPORTED IN OPERATING MEMBER

CROSS-REFERENCE

Applicant claims priority from PCT Application PCT/IB2003/006085 filed 19 Dec. 2003 based on French patent application 03 00266 filed 10 Jan. 2003.

BACKGROUND OF THE INVENTION

It is known to integrate a light source in a commutation switch device so the light source lights the control button attached to the device. Such a switch device conventionally includes one or more resiliently deformable conductive strips which are displaced under the action of the operating member. Electrical connection terminals lie at the bottom of the switch device casing and allow connection to a printed circuit by soldering.

In order to be visible from the operating region, the light source must be arranged opposite the connection terminals and adjacent a push button. It is desirable but difficult for the electrical conductors which supply current to the light source from the connection terminals to extend through the switching mechanism, and this often leads to a larger switch device. As a result, switching devices which comprise a light source either have relatively large dimensions or are of complex design.

SUMMARY OF THE INVENTION

The invention provides a commutation, or switch device of reduced size which allows a light source, or light to be supplied with current in a switch device of simple and rugged design. The switch device includes at least two energizing conductors that have top parts that engage terminals of the light. The operating apparatus includes an operating member with a lower end that operates the switch mechanism and a transparent button lying over the operating member and under the light, and which is manually depressed. The operating apparatus has an upwardly-opening cavity and the light and tongues on the energizing conductors lie in the cavity. The energizing conductors are pieces of sheet metal that have legs that extend down to the bottom of the casing and that have lugs thereat that form solder terminals.

The invention will be better understood from a reading of the following description which is given purely by way of example with reference to the drawings.

DESCRIPTION OF THE PREFERRED EMBODIMENTS

Figure 1A:
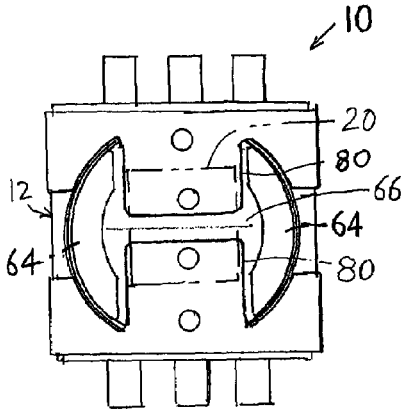
FIG. 1A is a plan view of the assembled switch device of FIG. 1, with the push button and light removed.
Figure 1:
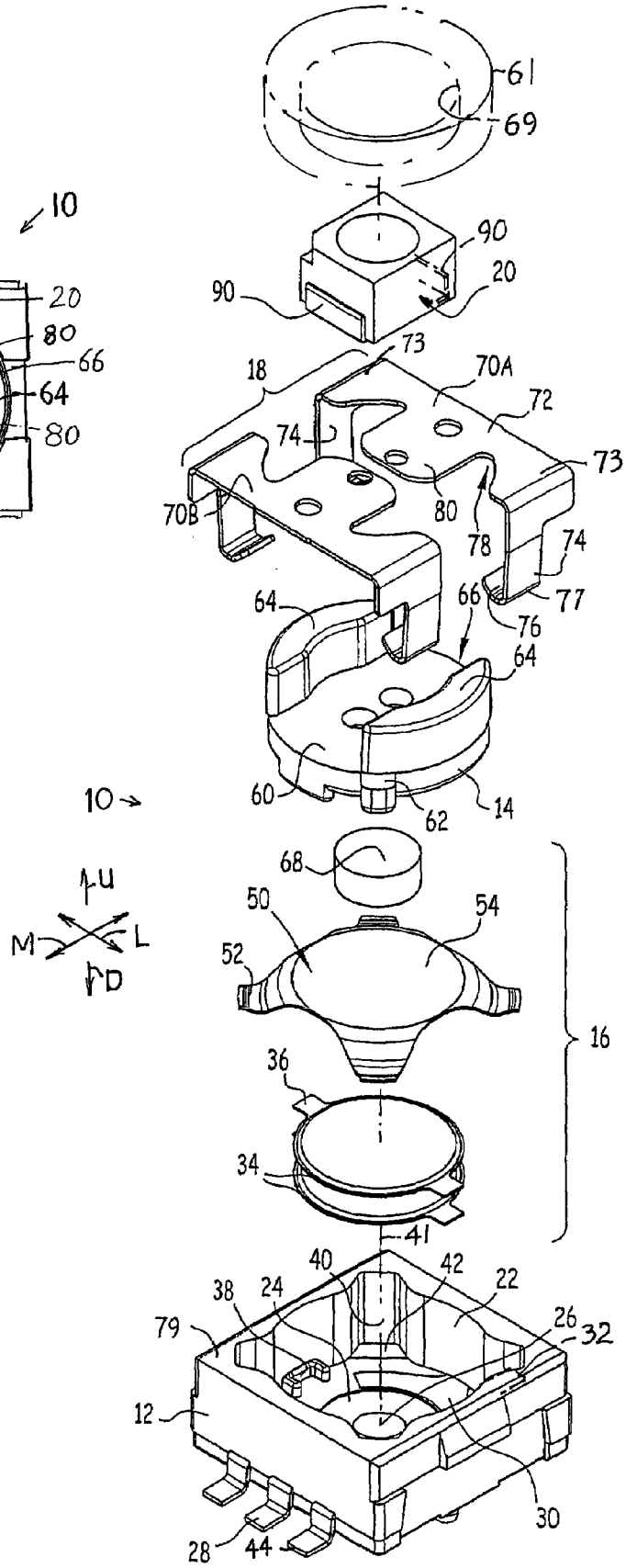
FIG. 1 is an exploded isometric view of a switch device according to the invention.

FIG. 1 shows a commutation, or switch device 10 which includes a casing 12, an operating member 14 which can move down D and up U relative to the casing and a commutation, or switching mechanism 16 which lies in the casing 12 under the operating member 14. The switch device further comprises a light source, or light 20 that includes a light-emitting diode, and an energizing arrangement 18 that supplies current to the light. A transparent push-button 61 is attached to the operating member 14 and lies above the light 20. This arrangement improves visual appearance and facilitates operation when the switching device is installed in an electronic piece of equipment such as a motor vehicle dashboard console.

The casing 12 is generally of parallelepipedal form. It is constructed from insulating plastic material. It forms a generally cylindrical cavity 22 which is closed at its lower end by a base 24. A center conductor 26 on the base is connected to a connection terminal 28 which protrudes from the base. An annular conductor 30 which lies around the center conductor is connected to a connection terminal 32 (FIG. 2) which protrudes from the base.

The switching mechanism 16 comprises two resilient conductive discs 34 which rest against the annular conductor 30. At rest, these discs 34 are spaced from the central conductor 26. The discs 34 have diametrically opposed positioning tabs 36. The casing 12 has notches 38 for receiving the tabs to fix the rotational positions of the discs 34.

The generally cylindrical surface 22 of the casing cavity is interrupted by four cut-outs 40 which are spaced at 90° about the vertical axis 41 of the device. The cut-outs 40 extend along radial lines into the cylindrical wall. A conductive region 42 lies at the bottom of each cut-out 40. Each conductive region 42 is connected to a connection terminal 44 which protrudes from the base of the casing.

The switching mechanism 16 comprises a resilient conductive bell 50 with four radially extending arms 52. The arms are angularly spaced at 90° and the free ends of the arms are received in the cut-outs 40 and rest on the four conductive regions 42. The arms 52 are downwardly deformed so in the rest position, the central region 54 of the bell lies higher than the ends of the arms that rest on the conductive regions 42. In particular, at rest the central region 54 is spaced from the conductive discs 34.

The operating member 14 is generally of cylindrical shape, with a circular base 60 having four radial projections 62 are angularly spaced by 90° to each other. The projections lie in the cut-outs 40 which guide the operating member in up and down movement. The operating member 14 has two diametrically opposed and laterally L spaced upward protuberances 64, which protrude above the upper surface of the base 60. The two protuberances together form a free space, or empty region, or operating member cavity 66 for receiving the light 20. A transparent push button 61 with a bottom recess 69 is mounted on the protuberances.

A spacer 68 which is formed from a resiliently compressible material is interposed between the central region of the bell 50 and the operating member 14. As illustrated in FIG. 1, the discs 34, the bell 50, the spacer 68 and the operating member 14 are stacked in this order from the base 24 of the casing.

In accordance with the present invention, the energizing arrangement 18 includes two sheet metal energizing conductors 70A, 70B that support the light 20 in or over the operating member cavity 66 and that carry current to the light to energize it. The energizing conductors partially surround the casing and close much of the open upper end of the casing cavity 22. The energizing conductors are generally U-shaped and are fixed to the casing 12 at legs 74 of the U-shape.

The two sheet metal energizing conductors 70A, 70B are longitudinally (M) spaced and are symmetrical relative to a lateral plane. Each energizing conductor has a top part 72 with laterally opposite sides 73 connected by a right angle bend to a pair of vertical legs 74. A lug 76 is formed at the lower end of each leg by a right angle bend 77. The lugs 76 of the same energizing conductor are bent to extend toward one another and are bent to lie under the bottom of the base 24 of the casing. The legs 74 extend down along the outside of the casing. The lugs are designed to be soldered to traces on a circuit board together with the other terminals 28, 32, 44. The top parts 72 lie against the top 79 of the casing and the top parts engage the operating member base 60 when the operating member is not depressed.

The top parts of the energizing conductors are longitudinally M spaced. They have cut-outs 78 and the protuberances 64 of the operating member extend through the cutouts. The energizing conductors form tongues 80 which support and connect to the light source 20. The tongues 80 further form a retaining stop that limits upward movement of the operating member. The tongues 80 extend into the operating member cavity 66 that lies between the two protuberances. Each energizing conductor 70A, 70B is formed from a single piece of sheet metal which has been cut and shaped as by stamping.

Figure 2:
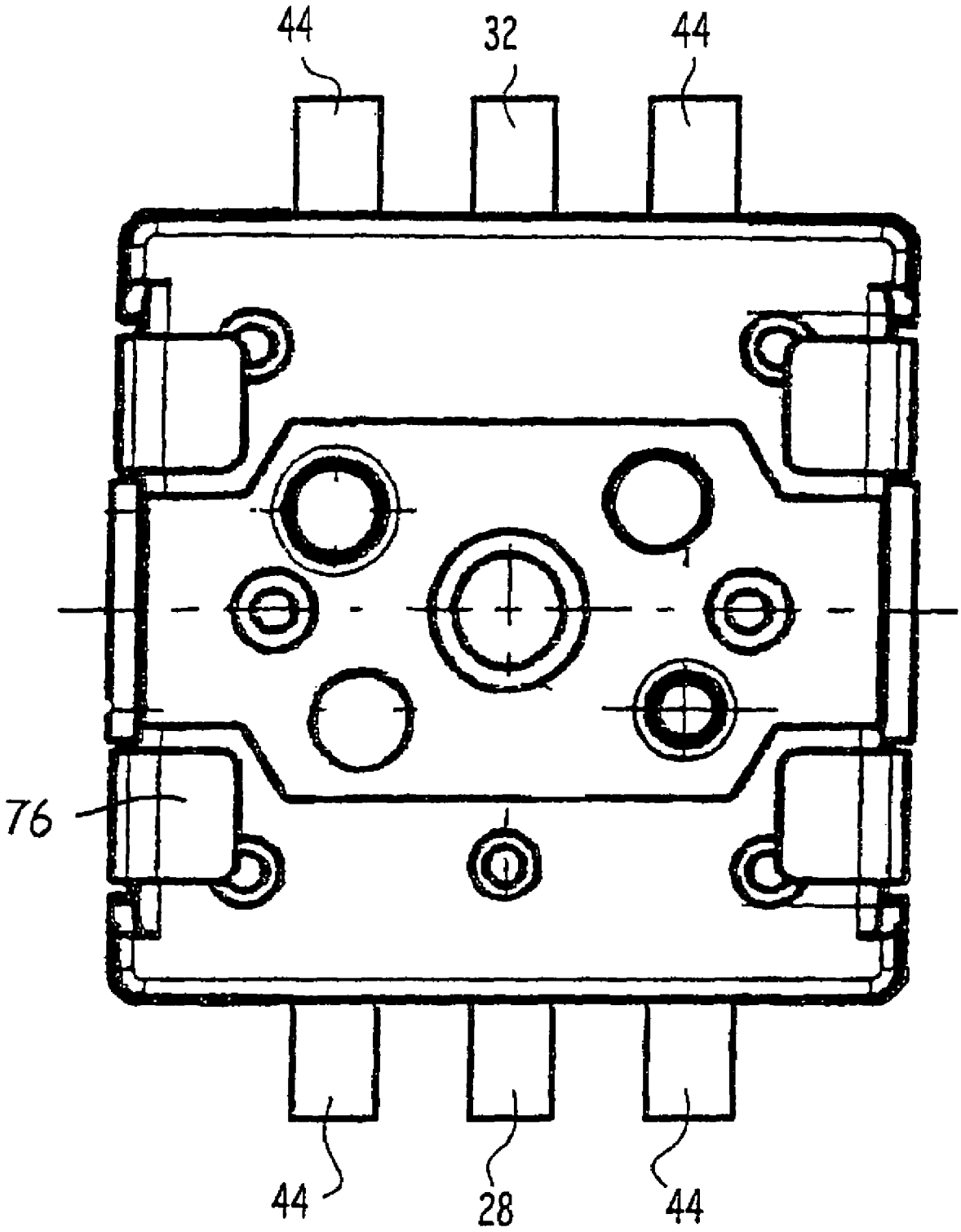
FIG. 2 is a view from below of the switch device of FIG. 1 showing the connection terminals.

In the embodiment of FIGS. 1, 1A and 2, the light source 20 includes a single light-emitting diode of the SMC type (Surface Mounted Component). The diode has a lower face and two terminals 90 which allow the diode to be mounted on a surface. The two terminals have coplanar flat surfaces. They allow surface connection, for example, by soldering the diode to the tongues 80 of the top parts 72 of the two energizing conductors. The light 20 is received in the cavity, or space 66 of the operating member 14, between the two protuberances 64 which protrude through the cut-outs 78.

When the operating member 14 is depressed, two contacts are successively connected. For the case of slight depression of the operating member 14, the bell 50 is resiliently deformed until it comes into contact with the domes 34. A connection is then made between the four terminals 44 that lead to the conductive regions 42 and the terminal 32 that leads to the conductive surface 30. For the case of greater depression of the operating member 14, the conductive discs 34 are deformed until they come into contact with the conductive region 26 on the casing base, thereby connecting the four terminals 44 and the terminals 28 (which connects to region 26) and 32. When the operating member is released, it once more takes up the rest position under the resilient action of the discs 34 and the bell 50.

The energizing conductors limit upward movement of the operating member 14, hold the light under the transparent push button 67, help close the top of the casing cavity, and provide current to the light, in a compact switch device. The lugs 76 which lie against the bottom surface of the casing 12 form connection terminals while ensuring the mechanical retention of the two energizing conductors to the casing 12.

Figure 3:
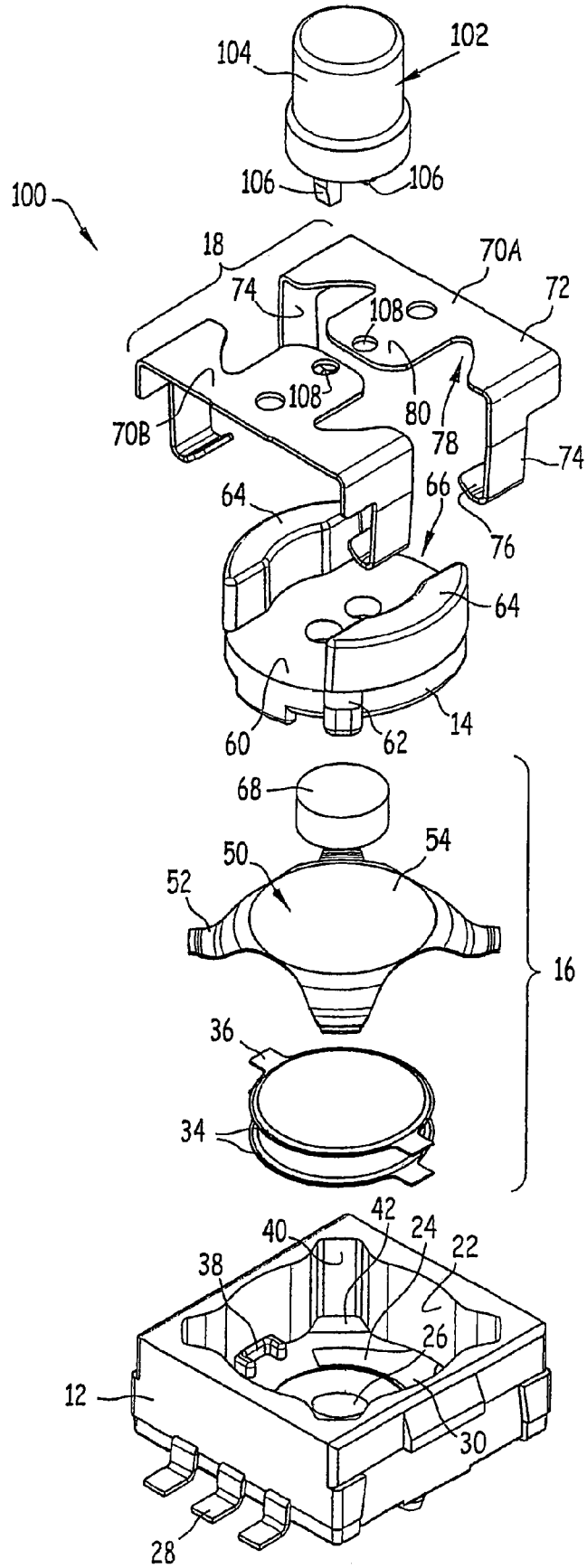
FIGS. 3 and 4 are exploded isometric views of variants of a switch device according to the invention.
Figure 4:
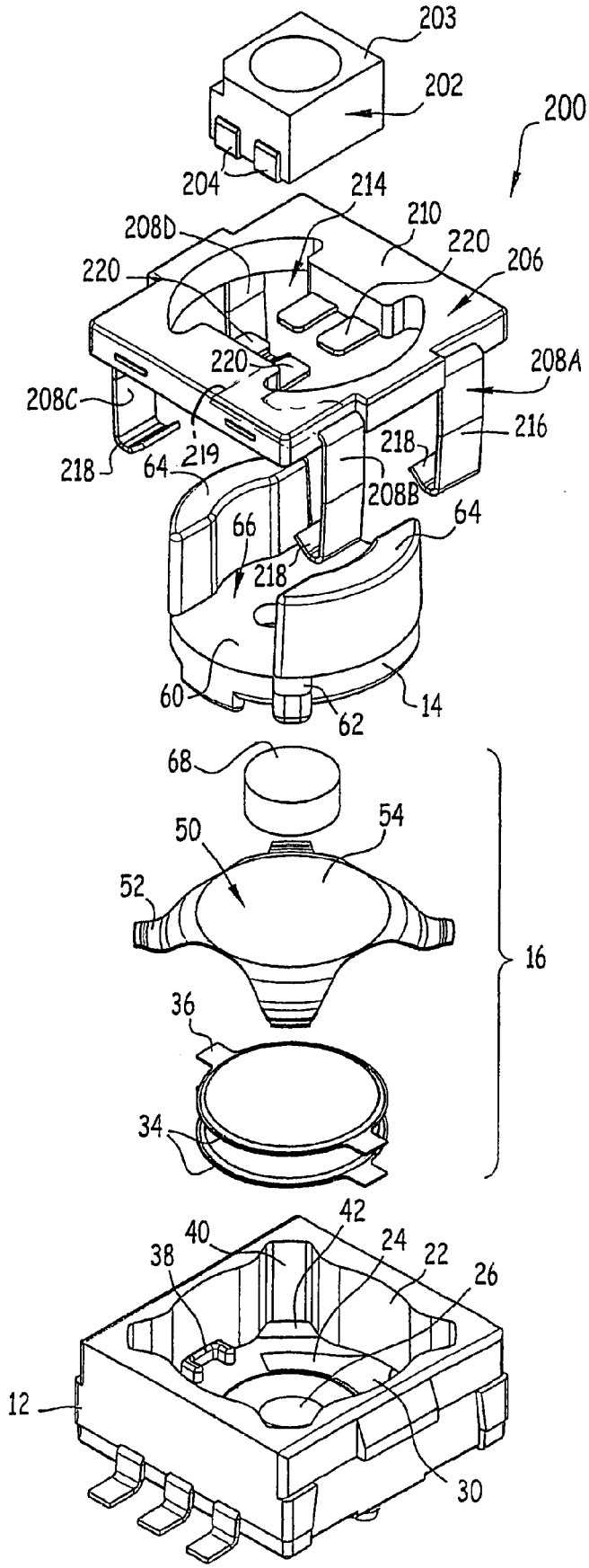

FIGS. 3 and 4 illustrate two variants of the switch device. In these Figures, elements identical or similar to those in the preceding Figures are identified using the same reference numerals.

The switch device 100 of FIG. 3 differs only in that the light source 102 includes a light emitting diode overlaid by a generally cylindrical translucent member 104 having two conductive tabs or rods 106. The tabs protrude downward beyond an end disc. The tabs project into openings 108 in the tongues 80 and are soldered thereto.

FIG. 4 shows a switch device 200 with a light 202 which includes two light-emitting diodes that are overmolded by the same transparent body 203. The light source has four connection terminals 204 which protrudes at the lower face. It would be possible to energize the two diodes in parallel using only three terminals.

In this embodiment, the energizing arrangement 206 for carrying current to the light source includes four separate energizing conductors 208A, 208B, 208C, 208D. These separate energizing conductors are connected mechanically to each other by an insulating frame 210 which is overmolded to portions of the top parts of the energizing conductors. The four energizing conductors each has a leg 216 with a lug 218 at its lower end which can engage the bottom surface of the base 24 of the casing and form a connection terminal. The top parts 219 of the energizing conductors have exposed tongues 220 that lie in the open space 66. The tongues connect to the four terminals of the light and support the light. The insulative frame 210 defines internal passages through which the protuberances 64 of the operating member extend and move slightly up and down.

Although terms such as "top", "bottom", etc. have been used to describe the invention as it is illustrated, it should be understood that the switch device can be used in any orientation.

The novel features of the invention are set forth with particularity in the appended claims. The invention will be best understood from the following description when read in conjunction with the accompanying drawings.

What is claimed is:

1. A switching device of a type that has a casing with an upwardly opening casing cavity, a switching mechanism lying in said casing, an operating member that is moveable to operate said switching mechanism, a light lying above at least part of said operating member and having a pair of light terminals, and at least two energizing conductors mounted on said casing for carrying electricity to said light, wherein:

said energizing conductors each has a top part that lies above a part of said operating member and that engages one of said light terminals, each energizing conductor having a leg that extends downwardly to the bottom of said casing, and each energizing conductor having a lug that lies at the bottom of its leg and that forms a terminal;

said operating member has an operator base and a pair of laterally spaced protuberances projecting upward from laterally opposite sides of said base and leaving an operator cavity between said protuberances;

said energizing conductors are each formed of a piece of sheet metal, the top part of each of said energizing conductors having side portions lying at longitudinally opposite sides of said operating member and said top parts having tongues projecting towards each other into said operator cavity, said side portions each extending laterally to a top of one of said legs.

2. The switching device described in claim 1 wherein said light has at least three terminals and said energizing conductors comprises at least three sheet metal energizing conductors, and wherein:

first and second of said energizing conductors have longitudinal side parts that lie on the same longitudinal side of said operating member and have first and second tongues that are laterally spaced and that each projects into said base cavity portion, said first and second energizing member top parts of said first and second energizing members extend laterally away from each other and each is joined by a right angle bend to one of said legs, each leg having a lower end joined to one of said lugs that extends under said base.

3. A switching device of a type that has a casing with an upwardly opening casing cavity, a switching mechanism lying in said casing, an operating apparatus that is depressable to operate said switching mechanism, a light having at least first and second light terminals, and at least first and second energizing conductors for carrying electricity to said light, wherein:

said operating apparatus has a depressable button and an operating member that is depressed by said button and that operates said switching mechanism when said button is depressed, and said operating apparatus forms an empty region under said button and above at least part of said operating member;

said first and second energizing conductors are each formed of sheet metal, are each fixed to said casing, each has a top part with a tongue that projects into said empty region, and each has a leg that extends downward from the top part of the energizing conductor with each leg having a lug at its bottom that forms a terminal lying at the level of the bottom of said casing;

said light lies in said empty region and said light terminals are each joined to a different one of said tongues;

said first and second energizing conductors have laterally opposite side portion that lie beyond opposite sides of said operating apparatus and that each connects one of said tongues to one of said legs.

4. A switching device of a type that has a casing with an upwardly opening casing cavity, a switching mechanism lying in said casing, an operating apparatus that is depressable to operate said switching mechanism, a light having at least first and second light terminals, and at least first and second energizing conductors for carrying electricity to said light, wherein:

said operating apparatus has a depressable button and an operating member that is depressed by said button and that operates said switching mechanism when said button is depressed, and said operating apparatus forms an empty region under said button and above at least part of said operating member;

said first and second energizing conductors are each formed of sheet metal, are each fixed to said casing, and each has a top part with a tongue that projects into said empty region, said energizing conductors forming legs that lie outside the casing with the legs having lugs that extend under the casing to fix the energizing conductors to the casing;

said light lies in said empty region and said light terminals are each joined to a different one of said tongues.

5. A switching device of a type that has a casing with an upwardly opening casing cavity, a switching mechanism lying in said casing, an operating apparatus that is depressable to operate said switching mechanism, a light having at least first and second light terminals, and at least first and second energizing conductors for carrying electricity to said light, wherein:

said operating apparatus has a depressable button and an operating member (14) that is depressed by said button and that operates said switching mechanism when said button is depressed, said operating member has a base (60) that lies under said button and above at least part of said switching mechanism with said operating member also having a pair of laterally (L) spaced upward projections (64) that extend up from said base and that form a cavity (66) between said projection and above the base, that has cavity longitudinally (M) open ends;

said first and second energizing conductors are each formed of sheet metal, are each fixed to said casing, each has a top part with a tongue (80) that projects longitudinally (M) into said cavity through said cavity open end, and each that lies closely above said base when the operating apparatus is not depressed;

said light lies in said cavity and said light terminals are each joined to a different one of said tongues in solder joints that lie in said cavity.

* * * * *